US010906704B2

(12) United States Patent
LaRocque

(10) Patent No.: US 10,906,704 B2
(45) Date of Patent: Feb. 2, 2021

(54) TAMPER EVIDENT CAP

(71) Applicant: Hyperkinetics Corporation, Williamstown, VT (US)

(72) Inventor: Mark LaRocque, Williamstown, VT (US)

(73) Assignee: Hyperkinetics Corporation, Williamstown, VT (US)

( * ) Notice: Subject to any disclaimer, the term of this patent is extended or adjusted under 35 U.S.C. 154(b) by 0 days.

(21) Appl. No.: 16/175,621

(22) Filed: Oct. 30, 2018

(65) Prior Publication Data

US 2019/0127122 A1 May 2, 2019

Related U.S. Application Data

(60) Provisional application No. 62/579,037, filed on Oct. 30, 2017.

(51) Int. Cl.

| | |
|---|---|
| ***B65D 41/32*** | (2006.01) |
| ***B65D 55/06*** | (2006.01) |
| ***F17C 13/06*** | (2006.01) |
| ***B65D 90/22*** | (2006.01) |
| ***B65D 63/10*** | (2006.01) |

(52) U.S. Cl.

CPC ..... *B65D 41/32* (2013.01); *B65D 55/06* (2013.01); *B65D 63/1027* (2013.01); *B65D 90/22* (2013.01); *F17C 13/06* (2013.01); *B65D 2211/00* (2013.01); *B65D 2401/15* (2020.05); *F17C 2205/0308* (2013.01); *F17C 2205/0311* (2013.01); *Y10T 24/1498* (2015.01)

(58) Field of Classification Search

CPC .... B65D 41/32; B65D 63/1027; B65D 90/22; B65D 55/06; B65D 2211/00; B65D 2101/0023; F17C 13/06; F17C 2205/0308; F17C 2205/0311; Y10T 24/1498

USPC ..... 220/375, 724; 215/253, 306; 24/16 PB

See application file for complete search history.

(56) References Cited

U.S. PATENT DOCUMENTS

| | | | | |
|---|---|---|---|---|
| 4,001,919 A * | 1/1977 | Moberg | B65D 33/34 | 24/16 PB |
| 4,586,570 A * | 5/1986 | Swift | A62C 13/76 | 169/75 |
| 4,712,705 A * | 12/1987 | Fuehrer | B65D 41/48 | 215/254 |
| 5,191,992 A * | 3/1993 | Darley | F17C 13/003 | 206/807 |

(Continued)

*Primary Examiner* — James N Smalley

(74) *Attorney, Agent, or Firm* — Stites & Harbison PLLC; Sean P. Ritchie

(57) ABSTRACT

Provided herein are an article and method for securing a fluid container. The article includes a tamper evident cap, comprising a head section including an inner surface, an outer surface, and a tab; and a tail section including tapered members extending therefrom. The inner surface is arranged and disposed to receive a valve or opening therein and the tail section is arranged and disposed to engage the tab. The method includes providing a tamper evident cap comprising a head section including an inner surface, an outer surface, and a tab, and a tail section including tapered members extending therefrom; positioning the inner surface of the head section over a valve or opening of the fluid container; passing the tail section through or around a portion of the fluid container; and inserting the tail section into an opening in the tab.

18 Claims, 5 Drawing Sheets

(56) References Cited

U.S. PATENT DOCUMENTS

| | | | | |
|---|---|---|---|---|
| 5,195,561 | A * | 3/1993 | Wilson | B60C 29/06 138/89.2 |
| 6,227,399 | B1 * | 5/2001 | Angus | B65D 63/1027 138/96 R |
| 6,449,808 | B1 * | 9/2002 | Zappa | G09F 3/037 24/16 PB |
| 6,854,616 | B2 * | 2/2005 | Steffan | B65D 59/06 215/254 |

* cited by examiner

TAMPER EVIDENT CAP

RELATED APPLICATION

This application claims the benefit of U.S. Provisional Application Ser. No. 62/579,037, filed Oct. 30, 2017, the entire disclosure of which is incorporated herein by this reference.

TECHNICAL FIELD

The present invention relates to articles and methods for securing fluid container. In particular, the presently-disclosed subject matter relates to a tamper evident cap and methods of use thereof.

BACKGROUND

Gasses and liquids are widely used in a variety of different industries. Typically, these fluids are transported from one location to another in a sealed container. In many instances, the containers are pressurized, such that the fluid can be released by opening a valve or port on the container. While this provides for easy delivery of the fluid, it is difficult to determine the quantity and/or composition of the fluid without opening the container. As such, it is often not possible to detect when a container has been tampered with prior to use. This becomes particularly challenging in applications where the quantity and/or concentration of fluid within each container is highly specific.

Accordingly, there is a need for articles and methods that secure fluid containers.

SUMMARY

This summary describes several embodiments of the presently-disclosed subject matter, and in many cases lists variations and permutations of these embodiments. This summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this summary or not. To avoid excessive repetition, this summary does not list or suggest all possible combinations of features.

The presently-disclosed subject matter provides, in some embodiments, a tamper evident cap, comprising a head section including an inner surface, an outer surface, and a tab; and a tail section including tapered members extending therefrom. The inner surface is arranged and disposed to receive a valve or opening therein and the tail section is arranged and disposed to engage the tab. In some embodiments, the tab includes an opening formed therein. In one embodiment, the opening includes at least one projection formed therein. In another embodiment, the tail section is arranged and disposed to slide through the opening. In a further embodiment, the at least one projection is arranged and disposed to engage the tapered members of the tail section and prevent removal of the tail section from the opening.

In some embodiments, the tapered members are cone shaped. In some embodiments, the head section includes a decreased thickness surrounding the tab. In one embodiment, the decreased thickness is arranged and disposed to break when pressure is applied to the tab. Additionally or alternatively, in some embodiments, the head section includes perforations surrounding the tab. In one embodiment, the perforations are arranged and disposed to break when pressure is applied to the tab. In some embodiments, the cap is plastic. In some embodiments, the cap is thermoplastic.

The presently-disclosed subject matter also provides, in some embodiments, a method of securing a fluid container, the method comprising providing a tamper evident cap comprising a head section including an inner surface, an outer surface, and a tab; and a tail section including tapered members extending therefrom; positioning the inner surface of the head section over a valve or opening of the fluid container; passing the tail section through or around a portion of the fluid container; and inserting the tail section into an opening in the tab. In one embodiment, the opening in the tab includes at least one projection formed therein, the at least one projection arranged and disposed to engage the tapered members of the tail section. In another embodiment, the at least one projection prevents removal of the tail section from the opening in the tab.

In some embodiments, the head section includes a decreased thickness surrounding the tab. In one embodiment, the method further comprises applying pressure to the tab, the pressure breaking the decreased thickness and releasing the tab from the head section to open the cap. In some embodiments, a portion of the tab extends past the outer surface of the head section. In one embodiment, the method further comprises applying pressure to the portion of the tab extending past the outer surface of the head section, the pressure breaking the decreased thickness and releasing the tab from the head section to open the cap.

BRIEF DESCRIPTION OF THE DRAWINGS

The presently-disclosed subject matter will be better understood, and features, aspects and advantages other than those set forth above will become apparent when consideration is given to the following detailed description thereof. Such detailed description makes reference to the following drawings, wherein.

Figure 1:
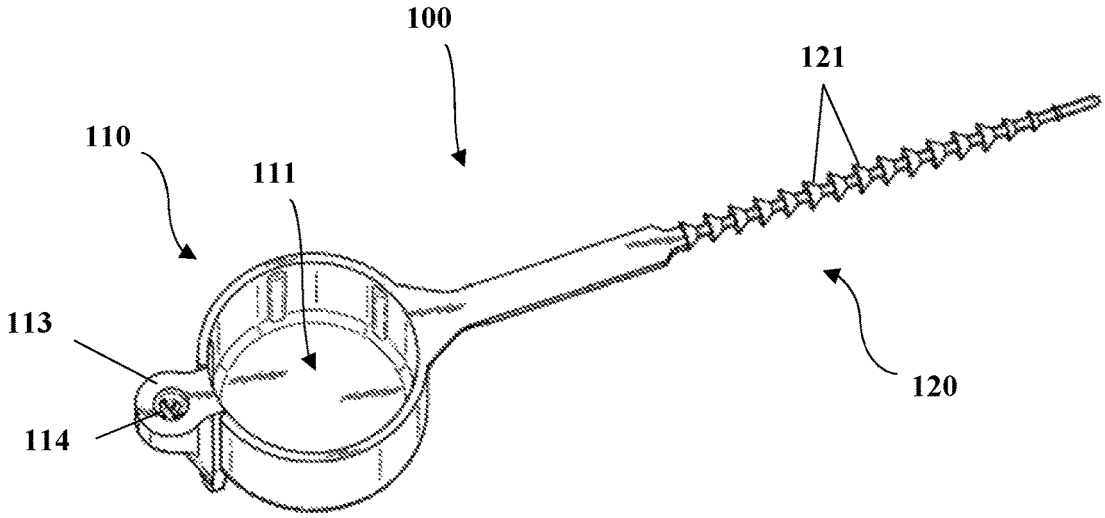
FIG. 1 is a top and front perspective view of the tamper evident cap, shown in an open position, in accordance with the present design.
Figure 2:
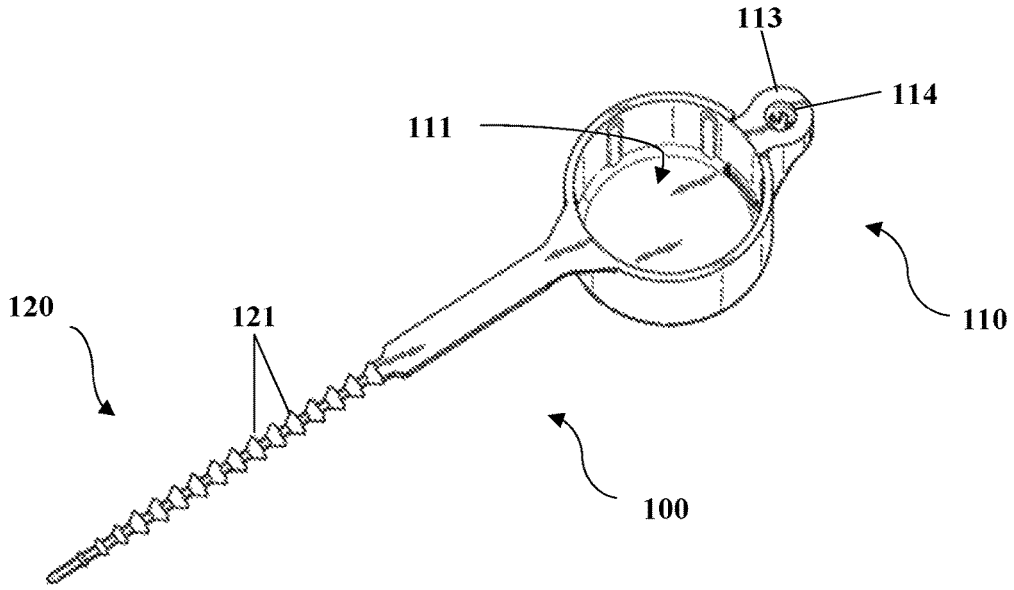
FIG. 2 is a top and back perspective view of the tamper evident cap shown in FIG. 1.
Figure 3:
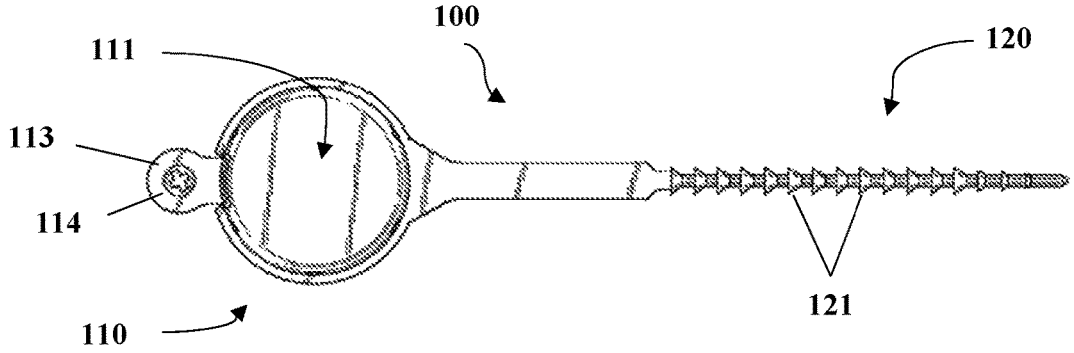
FIG. 3 is a top view of the tamper evident cap shown in FIG. 1.
Figure 4:
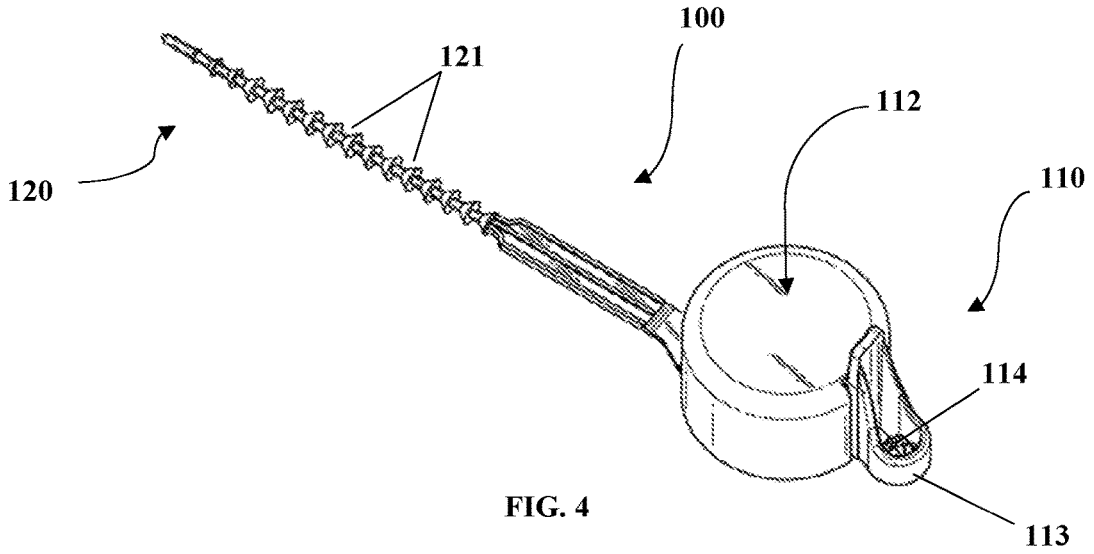
FIG. 4 is a bottom and front perspective view of the tamper evident cap shown in FIG. 1.
Figure 5:
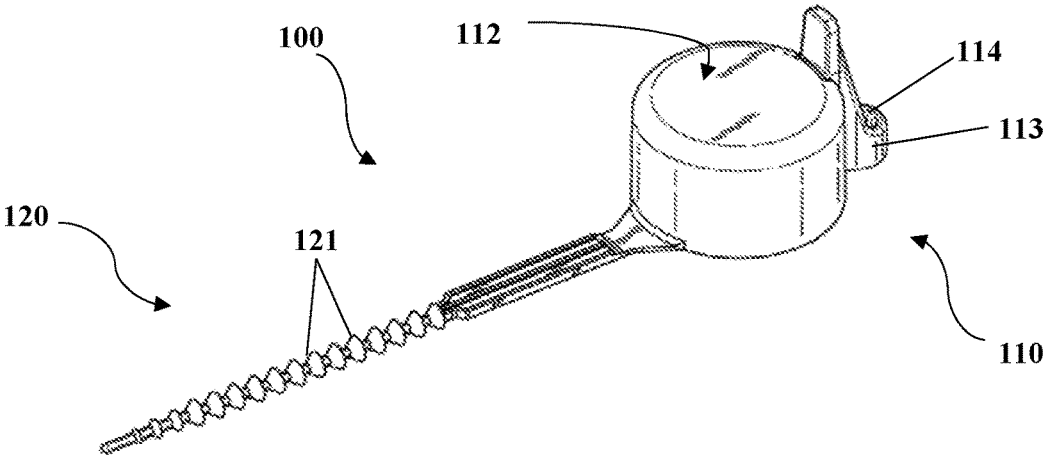
FIG. 5 is a bottom and back perspective view of the tamper evident cap shown in FIG. 1.
Figure 6:
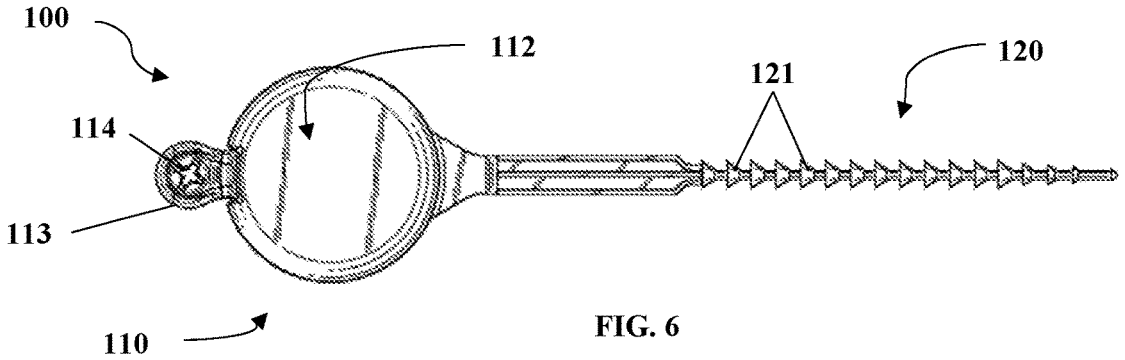
FIG. 6 is a bottom view of the tamper evident cap shown in FIG. 1.
Figure 7:
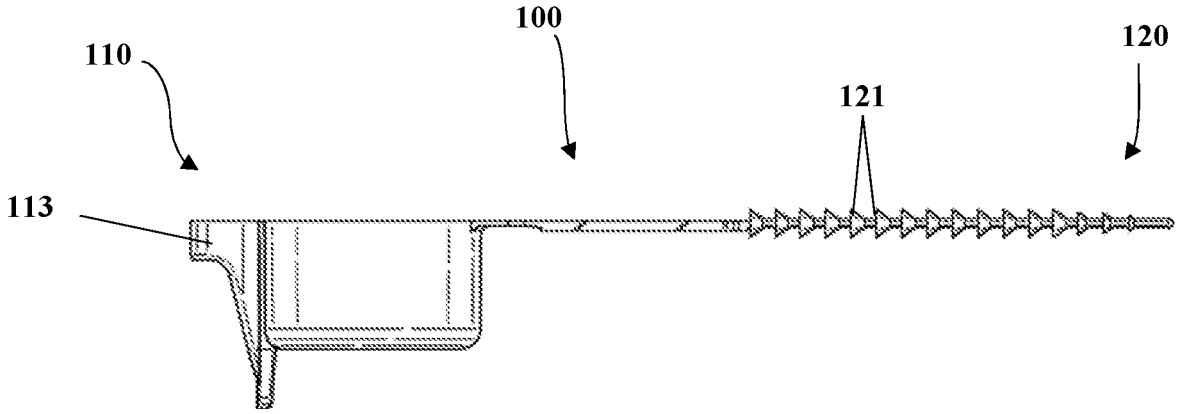
FIG. 7 is a side view of the tamper evident cap shown in FIG. 1.
Figure 8:
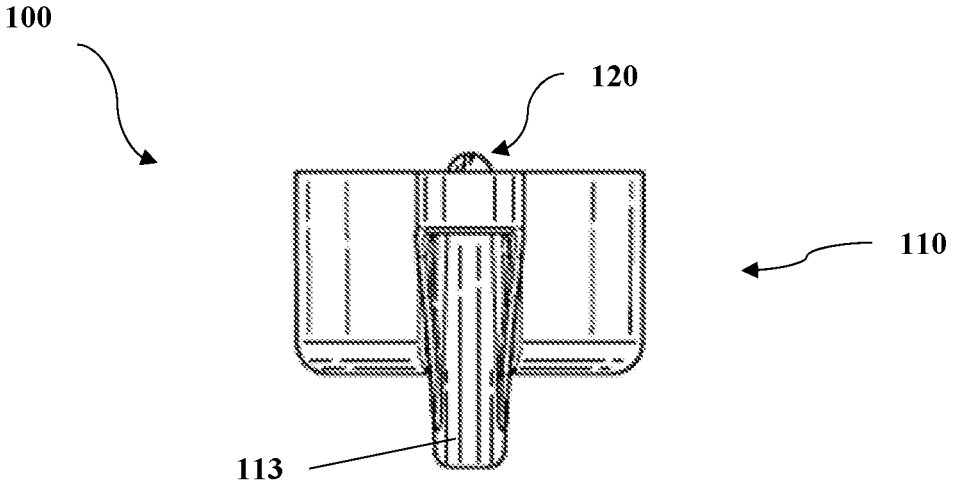
FIG. 8 is a front view of the tamper evident cap shown in FIG. 1.
Figure 9:
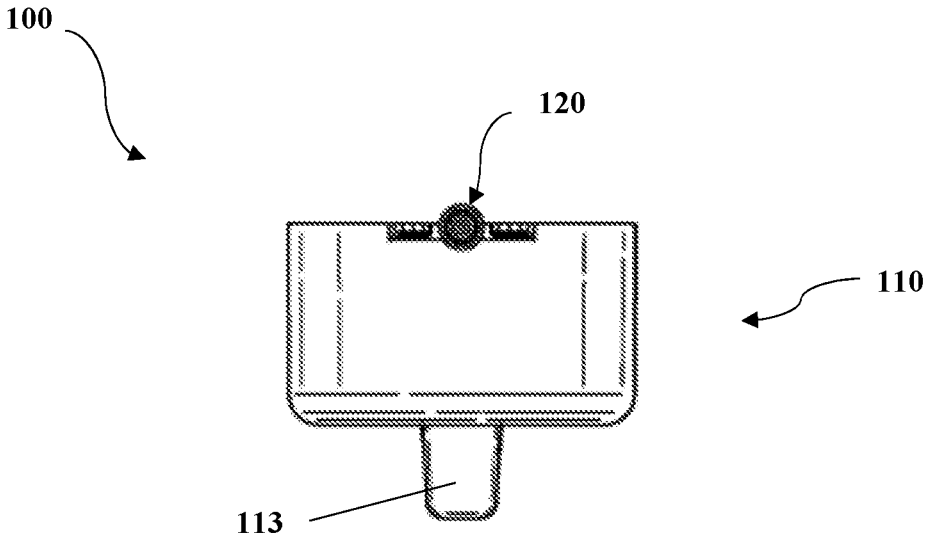
FIG. 9 is a back view of the tamper evident cap shown in FIG. 1.

While the disclosure is susceptible to various modifications and alternative forms, specific embodiments thereof have been shown by way of example in the drawings and are herein described below in detail. It should be understood, however, that the description of specific embodiments is not intended to limit the disclosure to cover all modifications, equivalents and alternatives falling within the spirit and scope of the disclosure as defined by the appended claims.

DEFINITIONS

Unless defined otherwise, all technical and scientific terms used herein have the same meaning as commonly understood by one of ordinary skill in the art to which the disclosure belongs. Any methods and materials similar to or equivalent to those described herein can be used in the practice or testing of the present disclosure, including the methods and materials are described below.

Following long-standing patent law convention, the terms "a," "an," and "the" refer to "one or more" when used in this application, including the claims. Thus, for example, reference to "a cell" includes a plurality of cells, and so forth.

The terms "comprising," "including," and "having" are intended to be inclusive and mean that there may be additional elements other than the listed elements.

Unless otherwise indicated, all numbers expressing quantities of ingredients, properties such as reaction conditions, and so forth used in the specification and claims are to be understood as being modified in all instances by the term "about." Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration, percentage, or the like is meant to encompass variations of in some embodiments ±50%, in some embodiments ±40%, in some embodiments ±30%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

All combinations of method or process steps as used herein can be performed in any order, unless otherwise specified or clearly implied to the contrary by the context in which the referenced combination is made.

DETAILED DESCRIPTION

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

The presently-disclosed subject matter relates to articles and methods for securing fluid containers. In some embodiments, as illustrated in FIGS. 1-12, the article includes a tamper evident cap 100. The cap 100 includes a head section 110 and a tail section 120. The head section 110 includes an inner surface 111 (FIGS. 1-3), an outer surface 112 (FIGS. 4-6), and a tab 113 (FIGS. 1-9). The inner surface 111 defines a recess in the cap. In one embodiment, the recess is arranged and disposed to receive a valve or opening of a fluid container therein.

Figure 10:
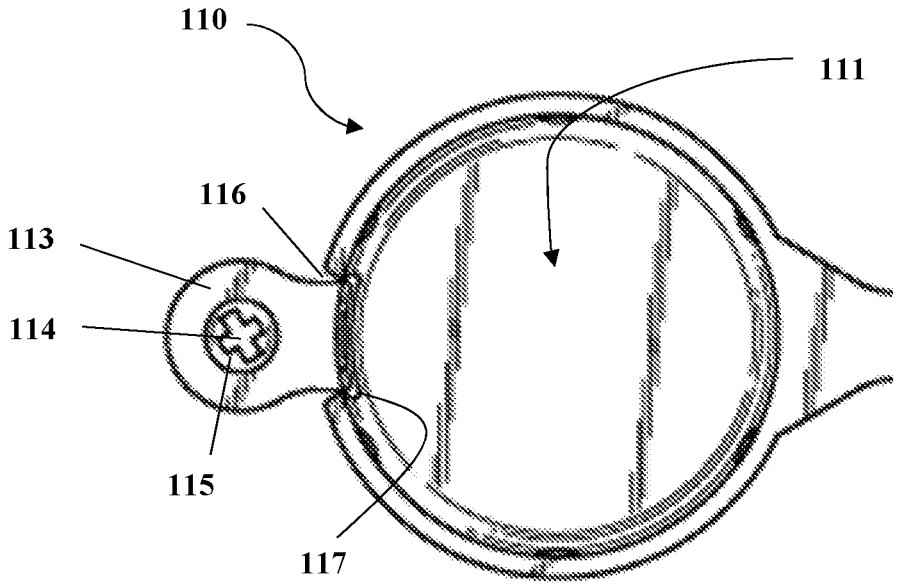
FIG. 10 is an enhanced view of a head section of the tamper evident cap shown in FIG. 1, according to an embodiment of the disclosure.

At least a portion of the tail section 120 includes tapered members 121 extending therefrom (FIGS. 1-7). The tapered members 121 of the tail section 120 are arranged and disposed to slide through an opening 114 (FIGS. 1-6) in the tab 113 on the head section 110. In some embodiments, the opening 114 includes at least one projection 115 (FIG. 10). In one embodiment, the at least one projection 115 only allows the tapered members 121 to pass through the opening 114 in a single direction. By only allowing the tapered members 121 to pass through in a single direction, the at least one projection 115 permits insertion of the tail section 120 through the tab 113 while simultaneously preventing removal therefrom. As such, in another embodiment, insertion of the tail section 120 through the opening 114 in the tab 113 provides a closed configuration that cannot be opened without breaking or destroying the cap 100. In a further embodiment, prior to insertion through the opening 114, the tail section 120 is arranged and disposed to engage a fluid container upon which the cap 100 is placed such that the cap cannot be removed from the container without breaking or destroying the cap 100. This securing of the cap 100 to the container with the tail section 120 forms a tamper evident closure, as the container cannot be tampered with without breaking the cap 100.

Figure 11:
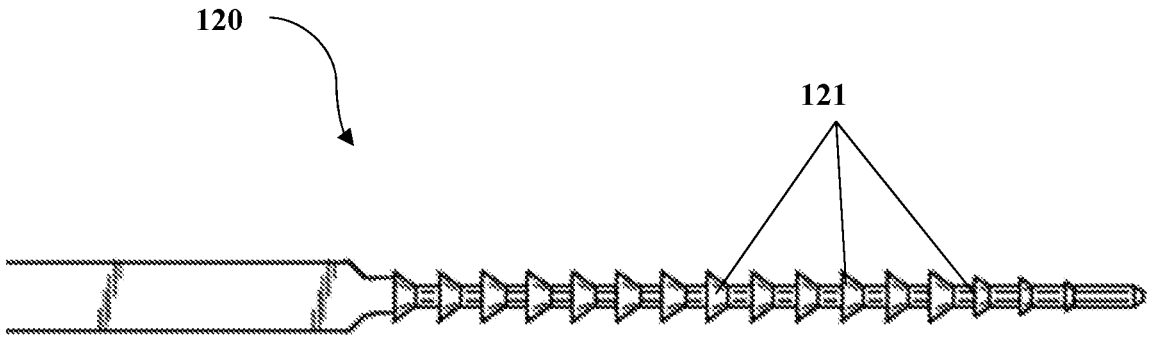
FIG. 11 is an enhanced view of a tail section of the tamper evident cap shown in FIG. 1, according to an embodiment of the disclosure.

Although shown with four (4) triangular shaped projections, as will be appreciated by those skilled in the art, the at least one projection 115 is not so limited and may include any other suitable shape and/or amount. Other suitable shapes for the at least one projection 115 include, but are not limited to, square, trapezoid, rounded, semicircular, any other geometric shape, or a combination thereof. Similarly, although shown as a plurality of cone shaped members, as will be appreciated by those skilled in the art, the tapered members 121 are not so limited and may include any other suitable shape and/or amount. Other suitable shapes for the tapered members 121 include, but are not limited to, triangular, pyramidal, semspherical, any other geometric shape arranged and disposed to engage the at least one projection 115 in a single direction, or a combination thereof. Additionally or alternatively, in certain embodiments, the size of the tapered members 121 may vary throughout the length of the tail section 120. For example, as illustrated in FIG. 11, the tapered members 121 may decrease in size at a distal end of the tail section 120, away from the head section 110. These tapered members 121 with decreased size pass more easily through the opening 114 as compared to larger tapered members 121, facilitating easier insertion of the distal end of the tail section 120 into the tab 113.

Figure 12:
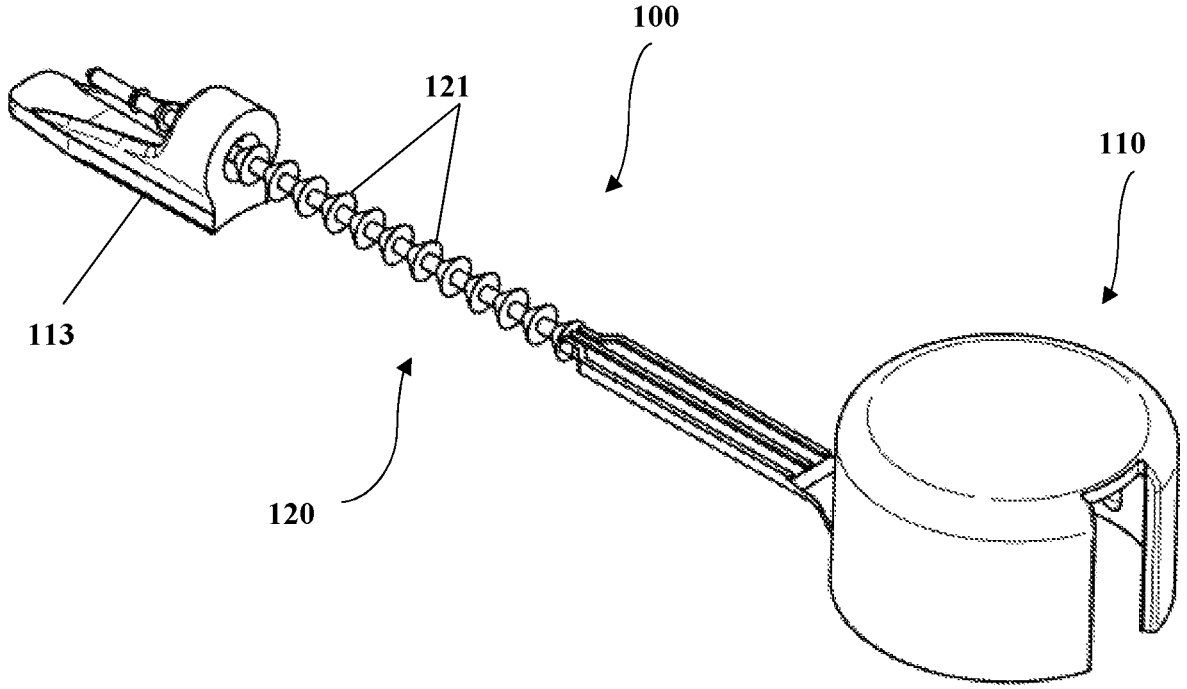
FIG. 12 is perspective view of the tamper evident cap after use.

The cap 100 is made from any suitable material and includes any suitable thickness. Suitable materials include, but are not limited to, polymers, plastics, synthetic plastics, thermoplastics, metals, alloys, or a combination thereof. In some embodiments, the tab 113 is breakably and/or removably secured to the head section 110. For example, in one embodiment, the head section 110 and the tab 113 are formed as a single piece, with a material of the head section 110 in an area surrounding the tab 113 having a decreased thickness 116 (FIG. 10) as compared to the rest of the head section 110. This decreased thickness 116 facilitates easy and precise removal of the tab 113 from the head section 110 to permanently open the cap 100 (FIG. 12). In another embodiment, the head section 110 may include gaps 117 (FIG. 10) or perforations surrounding the tab 113, the gaps 117 or perforations similarly facilitating easy and precise removal of the tab 113 from the head section 110.

In some embodiments, as illustrated in FIGS. 1, 4-5, and 7-9, a portion of the tab 113 may extend past the outer surface 112 of the head section 110. Applying pressure to this extension breaks or removes the tab 113 from the head section 110, further facilitating easy removal thereof. Accordingly, in certain embodiments, the cap 100 may be opened by hand, thus eliminating the need for specialized tools or instruments, such as scissors or blades that can potentially cause injury.

Also provided herein, in some embodiments, is a method of securing a fluid container. In one embodiment, the method includes positioning the head section 110 of the cap 100 over a valve or opening on a fluid container, passing the tail section 120 through and/or around a portion of the fluid container, and then inserting the tail section 120 into the opening 114 in the tab 113. The tail section 120 is pulled tightly through the opening 114 in the tab 113 to secure the cap 100 over the valve or opening, such that the cap 100 cannot be removed from the valve or opening without opening or breaking the cap 100. Since the valve or opening in the container cannot be accessed without breaking the cap 100, a closed cap 100 indicates that the fluid container has not been tampered with. Additionally, since the cap 100 can be opened by hand, the cap 100 reduces the risk of injury from using cutting tools. As will be appreciated by those skilled in the art, the fluid container may include any suitable container, such as, but not limited to, a liquid container, a gas container, a pressurized container, or a combination thereof.

While the disclosure is susceptible to various modifications and alternative forms, specific embodiments thereof have been shown by way of example in the drawings and are herein described below in detail. It should be understood, however, that the description of specific embodiments is not intended to limit the disclosure to cover all modifications, equivalents and alternatives falling within the spirit and scope of the disclosure as defined by the appended claims.

What is claimed is:

1. A tamper evident cap, comprising:

a head section including an inner surface, an outer surface, and a tab; and a tail section including tapered members extending therefrom;

wherein the inner surface is arranged and disposed to receive a valve or opening therein; and wherein the tail section is arranged and disposed to engage the tab;

wherein the head section includes a decreased thickness surrounding the tab, perforations surrounding the tab, or a combination thereof; and wherein the tab includes an extension portion that extends past the outer surface of the head section opposite a recess defined by the inner surface.

2. The cap of claim 1, wherein the tab includes an opening formed therein.

3. The cap of claim 2, wherein the opening includes at least one projection formed therein.

4. The cap of claim 3, wherein the tail section is arranged and disposed to slide through the opening.

5. The cap of claim 4, wherein the at least one projection is arranged and disposed to engage the tapered members of the tail section.

6. The cap of claim 5, wherein the at least one projection is arranged and disposed to prevent removal of the tail section from the opening.

7. The cap of claim 1, wherein the tapered members are cone shaped.

8. The cap of claim 1, wherein the decreased thickness is arranged and disposed to break when pressure is applied to the tab.

9. The cap of claim 1, wherein the perforations are arranged and disposed to break when pressure is applied to the tab.

10. The cap of claim 1, wherein the cap is plastic.

11. The cap of claim 1, wherein the cap is thermoplastic.

12. The cap of claim 1, wherein the tab and the tail section independently extend from the head section.

13. A method of securing a fluid container, the method comprising:

providing a tamper evident cap comprising:

a head section including an inner surface, an outer surface, and a tab; and a tail section including tapered members extending therefrom;

wherein the head section includes a decreased thickness surrounding the tab, perforations surrounding the tab, or a combination thereof;

wherein the tab includes an extension portion that extends past the outer surface of the head section opposite a recess defined by the inner surface;

positioning the inner surface of the head section over a valve or opening of the fluid container;

passing the tail section through or around a portion of the fluid container; and inserting the tail section into an opening in the tab.

14. The method of claim 13, wherein the opening in the tab includes at least one projection formed therein, the at least one projection arranged and disposed to engage the tapered members of the tail section.

15. The method of claim 14, wherein the at least one projection prevents removal of the tail section from the opening in the tab.

16. The method of claim 13, further comprising applying pressure to the tab, the pressure breaking the decreased thickness and releasing the tab from the head section to open the cap.

17. The method of claim 13, wherein a portion of the tab extends past the outer surface of the head section.

18. The method of claim 17, further comprising applying pressure to the portion of the tab extending past the outer surface of the head section, the pressure breaking the decreased thickness and releasing the tab from the head section to open the cap.

* * * * *